US008895492B2

(12) United States Patent
Tarng et al.

(10) Patent No.: US 8,895,492 B2
(45) Date of Patent: Nov. 25, 2014

(54) DILUTABLE CONCENTRATED CLEANING COMPOSITION COMPRISING A DIVALENT METAL SALT

(75) Inventors: Jiashi Tarng, Cranbury, NJ (US); Joan Gambogi, Hillsborough, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 13/993,104

(22) PCT Filed: Dec. 13, 2010

(86) PCT No.: PCT/US2010/060080

§ 371 (c)(1),
(2), (4) Date: Jun. 11, 2013

(87) PCT Pub. No.: WO2012/082096

PCT Pub. Date: Jun. 21, 2012

(65) Prior Publication Data

US 2013/0281344 A1 Oct. 24, 2013

(51) Int. Cl.

| | |
|---|---|
| ***C11D 1/83*** | (2006.01) |
| ***C11D 1/94*** | (2006.01) |
| ***C11D 17/00*** | (2006.01) |
| ***C11D 3/04*** | (2006.01) |
| *C11D 1/90* | (2006.01) |
| *C11D 1/75* | (2006.01) |
| *C11D 1/29* | (2006.01) |
| *C11D 1/22* | (2006.01) |

(52) U.S. Cl.

CPC ..... *C11D 17/0008* (2013.01); *C11D 1/90* (2013.01); *C11D 1/75* (2013.01); *C11D 1/29* (2013.01); *C11D 3/046* (2013.01); *C11D 1/94* (2013.01); *C11D 1/83* (2013.01); *C11D 1/22* (2013.01)

USPC ..... 510/237; 510/235; 510/362; 510/365; 510/421; 510/422; 510/426; 510/427; 510/428; 510/490

(58) Field of Classification Search

USPC ..... 510/235, 237, 362, 365, 421, 422, 426, 510/427, 428, 490

See application file for complete search history.

(56) References Cited

U.S. PATENT DOCUMENTS

| | | | | |
|---|---|---|---|---|
| 2,503,280 | A | 4/1950 | Lockwood | |
| 2,507,088 | A | 5/1950 | Bradley | |
| 3,260,744 | A | 7/1966 | Kenkichi et al. | |
| 3,320,174 | A | 5/1967 | Rubinfeld | |
| 3,372,188 | A | 3/1968 | Alston et al. | |
| 3,741,911 | A | 6/1973 | Shane | |
| 4,129,515 | A | 12/1978 | Foster et al. | |
| 4,316,824 | A | 2/1982 | Pancheri | |
| 5,057,246 | A | 10/1991 | Bertho et al. | |
| 5,439,615 | A | 8/1995 | Lefebvre et al. | |
| 5,700,773 | A * | 12/1997 | Jakubicki et al. | 510/426 |
| 5,799,773 | A | 9/1998 | Heffelfinger et al. | |
| 5,861,367 | A | 1/1999 | Blanvalet et al. | |
| 5,922,664 | A | 7/1999 | Cao et al. | |
| 6,040,071 | A | 3/2000 | Motyka et al. | |
| 6,051,543 | A | 4/2000 | Tarng et al. | |
| 6,277,803 | B1 * | 8/2001 | Tarng et al. | 510/237 |
| 6,455,481 | B1 | 9/2002 | Drapier et al. | |
| 6,617,296 | B1 | 9/2003 | Connors et al. | |
| 6,774,099 | B1 | 8/2004 | Scheibel et al. | |
| 2003/0050200 | A1 | 3/2003 | Chen | |
| 2004/0053804 | A1 * | 3/2004 | Yomogida et al. | 510/424 |
| 2005/0043194 | A1 * | 2/2005 | Macaulay et al. | 510/130 |
| 2007/0287648 | A1 | 12/2007 | Moaddel et al. | |
| 2009/0264334 | A1 | 10/2009 | Ferreyra et al. | |
| 2010/0240752 | A1 | 9/2010 | Dreilinger et al. | |
| 2011/0000500 | A1 | 1/2011 | Luna | |
| 2012/0129955 | A1 * | 5/2012 | Bernhardt et al. | 514/784 |
| 2012/0208898 | A1 * | 8/2012 | Dong et al. | 514/785 |

FOREIGN PATENT DOCUMENTS

| | | |
|---|---|---|
| DE | 735096 | 5/1943 |
| DE | 10023437 | 11/2001 |
| EP | 2026757 | 8/2010 |
| EP | 2094827 | 10/2010 |
| FR | 2588013 | 4/1987 |
| NZ | 240040 | 5/1995 |
| NZ | 244226 | * 8/1995 |
| WO | WO 99/16854 | 4/1999 |
| WO | 01/79403 | * 10/2001 |
| WO | 01/79404 | * 10/2001 |
| WO | WO 01/79403 | 10/2001 |
| WO | WO 01/79404 | 10/2001 |
| WO | WO 01/85896 | 11/2001 |
| WO | 03/083024 | * 10/2003 |
| WO | WO 03/083024 | 10/2003 |
| WO | WO 2004/016680 | 2/2004 |
| WO | WO 2005/016304 | 2/2005 |
| WO | WO 2008/074667 | 6/2008 |
| WO | WO 2009/103669 | 8/2009 |
| WO | WO 2009/154615 | 12/2009 |

OTHER PUBLICATIONS

International Search Report and Written Opinion in International Application No. PCT/US10/060080, mailed Mar. 2, 2012.

* cited by examiner

*Primary Examiner* — Charles Boyer
(74) *Attorney, Agent, or Firm* — Michael F. Morgan

(57) ABSTRACT

This application relates to a dilutable aqueous liquid cleaning composition, typically a dishwashing liquid, which comprises a plurality of surfactants, the surfactants including surfactant active components comprising from greater than 30% to up to 55% by weight, based on the weight of the composition, wherein the composition has a viscosity of 100 to 500 mPas as measured at 25° C., and the composition is dilutable with water to form a non-gelling diluted composition having up to six times the volume of the undiluted composition and a viscosity within the range of 100 to 1600 mPas as measured at 25° C. at any dilution up to the six times dilution.

33 Claims, No Drawings

DILUTABLE CONCENTRATED CLEANING COMPOSITION COMPRISING A DIVALENT METAL SALT

BACKGROUND

For cleaning compositions such as hand dishwashing liquids, a correct consistency or viscosity is very important to consumers' perception of the products. The desired viscosity, expected by the consumer, should not be too thick or too thin. The consumer desires a liquid viscosity providing liquid pourability and ease of dissolution in water. To be consumer acceptable, liquid cleaning products like hand dishwashing liquids must be able to provide good cleaning and manifest the foaming and rinsing properties which consumers today expect from a commercial liquid detergent. Finally, the dissolution rate of the liquid in water is desired to be rapid so that foam generation is not delayed. Foam is a signal to consumers that the detergent is high quality. Pourability and dissolution are in part linked to liquid viscosity.

In addition, there is a general desire for cleaning formulations that are environmentally sustainable and so have reduced impact to the environment but exhibit satisfactory performance and aesthetics, at least comparable to previous less sustainable compositions.

Some liquid consumer products are sold in a concentrated form and the consumer dilutes the concentration at home. This enables products to be sold in a smaller package to reduced packaging waste, with corresponding reduced transportation costs.

There is a need for cleaning compositions, in particular hand dishwashing liquids, which can be sold in concentrated form and are readily dilutable at home by the consumer to achieve the desired viscosity properties, which properties not only present in the initial concentrated composition but also are achieved over a wide dilution range.

BRIEF SUMMARY

An aqueous liquid cleaning composition comprising a. a plurality of surfactants, the surfactants including surfactant active components comprising from greater than 30% to up to 55% by weight, based on the weight of the composition, wherein the plurality of surfactants includes
   i. at least one anionic surfactant, the total anionic surfactant active component comprising from greater than 20% to up to 40% by weight, based on the weight of the composition; and
   ii. at least one additional surfactant selected from at least one amphoteric surfactant and at least one nonionic surfactant, wherein when at least one amphoteric surfactant is present, the total amphoteric active component comprises from greater than 5% to up to 15% by weight, based on the weight of the composition; and when at least one nonionic surfactant is present, the total nonionic active component comprises from greater than 5% to up to 15% by weight, based on the weight of the composition;

b. at least one divalent metal salt in an amount of 1.5% to 5% by weight, based on the weight of the composition; and c. water;

wherein the composition has a viscosity of 100 to 500 mPas as measured at 25° C., and the composition is dilutable with water to form a non-gelling diluted composition having up to six times the volume of the undiluted composition and a viscosity within the range of 100 to 1600 mPas as measured at 25° C. at any dilution up to the six times dilution.

Also, a package containing the composition, wherein the package has instructions associated therewith instructing a user to dilute the composition with water to a particular amount, the amount being selected from a dilution value and a dilution range.

Also, a method of preparing a diluted aqueous liquid cleaning composition, the method comprising the step of diluting, with water, a concentrated aqueous liquid cleaning composition to form a diluted composition that is non-gelling composition having up to six times the volume of the concentrated composition and a viscosity within the range of 100 to 1600 mPas as measured at 25° C. at any dilution up to the six times dilution.

The preferred embodiments provide liquid cleaning compositions, especially dishwashing liquids, which are formulated to permit easy viscosity control by the consumer upon dilution with water. The cleaning liquid may be sold in concentrated faun and, upon dilution by the consumer, can display stable viscosities within a desired range over a wide range of activity levels, the activity levels reducing with increased dilution.

The preferred embodiments particularly provide a viscosity property in a liquid cleaning compositions, which is a dilutable concentrated cleaning liquid, so that the liquid can be easily diluted with water by several folds and still retain a viscosity that is acceptable to consumers. A relatively constant viscosity is maintained, from the undiluted composition through to the desired diluted composition, irrespective of the dilution level across a broad dilution range, typically up to six times dilution with water. The concentrated composition can easily be diluted by the consumer at home by combining with water and inverting or gentle shaking of the package, which reliably forms a homogeneous single phase diluted composition. No gel phase (typically having a viscosity greater than 10,000 mPas) is formed during the dilution process, and the viscosity remains substantially constant, as discussed hereinafter.

Typical challenges in formulating highly concentrated surfactant-containing cleaning compositions include: reduced free water in the composition as a result of increased active ingredient content, which can render homogeneous dilution difficult; the formation of gel phases throughout the dilution process; increased processing time; longer deaeration times (i.e. for air bubble removal) upon dilution of the composition, which results from higher viscosity causing longer deaeration times; and maintaining a viscosity profile both before and after dilution that provide a similar cleaning performance at dilution as compared to conventional non-reconstitutable cleaning compositions.

These challenges are at least partly overcome by providing a substantially flat viscosity profile on dilution with the avoidance of gel phases. Mixing is facilitated, reducing processing and deaeration times. The composition remains visually clear. A desired viscosity range is not critically dependent upon the dilution level. Consumer perceived performance is made more uniform.

The preferred cleaning compositions can offer opportunities for producing more sustainable or more eco-friendly cleaning products that can be sold in a smaller package to reduced packaging waste, and then to be diluted by consumers to a regular dishwashing liquid at home in a reusable container. Alternatively, the composition may be used in super-concentrated form, in which case the composition readily dilutes in water. Such a concentrated composition saves packaging cost and reduces packaging waste and recycling.

DETAILED DESCRIPTION

As used throughout, ranges are used as shorthand for describing each and every value that is within the range. Any value within the range can be selected as the terminus of the range.

Unless otherwise stated, references to weight % in this specification are on an active basis in the total composition.

The aqueous liquid cleaning composition is formulated to provide the property of a pourable viscosity, both in concentrated or undiluted form, and in diluted form. The aqueous liquid cleaning composition is also desirably formulated to be visibly clear, both concentrated or undiluted form, and in diluted form. Yet further, both in concentrated or undiluted form, and in diluted form, the aqueous liquid cleaning composition is in the form of a liquid which is homogeneous and does not include a gel phase. The compositions are visually clear, independent of the degree of dilution.

Provided is an aqueous liquid cleaning composition comprising a plurality of surfactants, the surfactants including surfactant active components comprising greater than 30% to up to 55% by weight, based on the weight of the composition. The plurality of surfactants includes at least one anionic surfactant, the total anionic surfactant active component comprising greater than 20% to up to 40% by weight or greater than 20 to 35% by weight, based on the weight of the composition; and at least one additional surfactant selected from at least one amphoteric surfactant and at least one nonionic surfactant, wherein when at least one amphoteric surfactant is present, the total amphoteric active component comprises greater than 5% to up to 15% by weight, based on the weight of the composition; and when at least one nonionic surfactant is present, the total nonionic active component comprises greater than 5% to up to 15% by weight, based on the weight of the composition.

Various active ingredient levels of the concentrated composition can be prepared by altering the weight ratio of the surfactants, in particular the weight ratio of the anionic surfactants to the amphoteric or nonionic surfactants, which in turn can alter the viscosity to a desired level and uniformity across dilution values.

The composition also includes at least one divalent metal salt in an amount of 1.5% to 5% by weight, based on the weight of the composition.

The composition includes water.

The composition has a viscosity of 100 to 500 mPas as measured at 25° C., and the composition is dilutable with water to form a non-gelling diluted composition having up to six times the volume of the undiluted composition and a viscosity within the range of 100 to 1600 mPas as measured at 25° C. at any dilution up to the six times dilution.

In some embodiments, the composition has a viscosity of 125 to 275 mPas as measured at 25° C., and the composition is dilutable with water to form a non-gelling diluted composition having up to six times the volume of the undiluted composition and a viscosity within the range of 120 to 900 mPas as measured at 25° C. at any dilution up to the six times dilution.

The composition is typically a dishwashing liquid.

In some embodiments, the surfactant active components comprise greater than 30% to up to 55% by weight or greater than 30 up to 45% by weight, based on the weight of the composition, and the total anionic surfactant active component comprises greater than 20% to up to 35% by weight, based on the weight of the composition.

In some embodiments, the at least one divalent metal salt comprises magnesium sulfate. In some embodiments, the at least one divalent metal salt is present in an amount of 2 to 4% by weight, based on the weight of the composition.

In some embodiments, the at least one anionic surfactant is selected from an alkyl sulfonate and an alkyl ethoxy sulfate. In some embodiments, the alkyl sulfonate is a linear alkyl benzene sulfonate, optionally magnesium linear alkyl benzene sulfonate or sodium linear alkyl benzene sulfonate. Typically, the linear alkyl benzene sulfonate is dodecyl benzene sulfonate. In some embodiments, the alkyl ethoxy sulfate is a fatty acid ethoxylate sulfate, optionally C12-C15 alkyl ethoxysulfate with 1.3 ethoxylate groups per molecule. Typically, the fatty acid ethoxylate sulfate is ammonium laureth sulfate.

In some embodiments, the at least one anionic surfactant comprises 10 to 15% by weight linear alkyl benzene sulfonate, and from 15 to 25% by weight fatty acid ethoxylate sulfate, each weight being of the anionic surfactant active component based on the weight of the composition.

In some other embodiments, the at least one anionic surfactant consists of a fatty acid ethoxylate sulfate. Optionally, the at least one anionic surfactant consists of 20 to 34% by weight fatty acid ethoxylate sulfate as anionic active component, the weight being based on the weight of the composition.

In some embodiments, the at least one amphoteric surfactant comprises at least one of cocoamidopropyl betaine and laurylamidopropyl betaine. In some embodiments, the at least one amphoteric active component is present in an amount of 10 to 13% by weight, based on the weight of the composition.

In some embodiments, the at least one nonionic surfactant comprises an amine oxide. In some embodiments, the amine oxide is at least one of lauramidopropylamine oxide and myristamidopropylamine oxide. In some embodiments, the at least one nonionic active component is present in an amount of 8 to 12% by weight, based on the weight of the composition.

In some embodiments, the surfactant components consist of 25 to 35% by weight anionic active component comprising a mixture of fatty acid ethoxylate sulfate and linear alkyl benzene sulfonate, and 8 to 12% by weight nonionic active component comprising an amine oxide, each weight based on the weight of the composition.

In some other embodiments, the surfactant components consist of at least one anionic surfactant and at least one amphoteric surfactant, wherein the weight ratio at total anionic active component to total amphoteric active component is from 1.7:1 to 4:1.

In some other embodiments, the surfactant components consist of 20 to 27% by weight anionic active component comprising a fatty acid ethoxylate sulfate, and 8 to 14% by weight amphoteric active component comprising at least one of cocoamidopropyl betaine and laurylamidopropyl betaine, each weight based on the weight of the composition. Optionally, the weight ratio at total anionic active component to total amphoteric active component is from 1.7:1 to 2.5:1.

In some other embodiments, the surfactant components consist of 28 to 34% by weight anionic active component comprising a fatty acid ethoxylate sulfate, and 8 to 12% by weight amphoteric active component comprising at least one of cocoamidopropyl betaine and laurylamidopropyl betaine, each based on the weight of the composition. Optionally, the weight ratio at total anionic active component to total amphoteric active component is from 2.7:1 to 4:1.

In certain embodiments, there is no more than 5, 4, 3, 2, 1, or 0.5 weight % by weight of the composition of a monovalent metal counterion, such as sodium, anionic surfactant. In other embodiments, the composition is free of monovalent metal counterion anionic surfactant.

The composition may further comprise at least one viscosity modifier selected from a polymer and a hydrotrope. Optionally, the polymer comprises a block copolymer of propylene oxide and ethylene oxide. Optionally, the polymer is present in an amount of 0.1 to 1% by weight based on the weight of the composition.

Also provided is a package containing the composition. The package has instructions associated therewith for instructing a user to dilute the composition with water to a particular amount, the amount being selected from a dilution value and a dilution range. Typically, the dilution value is within a dilution range of three to six times the volume of the undiluted composition.

Also provided is a method of preparing a diluted aqueous liquid cleaning composition, the method comprising the step of diluting, with water, a concentrated aqueous liquid cleaning composition to form a diluted composition which is non-gelling composition having up to six times the volume of the concentrated composition and a viscosity within the range of 100 to 1600 mPas as measured at 25° C. at any dilution up to the six times dilution.

The aqueous liquid cleaning compositions include anionic surfactants, for example alkyl sulfonate or alkyl ethoxy sulfate surfactants, and other surfactants which may be nonionic surfactants, for example amine oxide surfactants, and/or amphoteric surfactants, for example betaine surfactants such as cocoamidopropyl betaine and/or laurylamidopropyl betaine.

As stated above, the compositions include a divalent metal salt that is a viscosity modifier. Such salts can include any desirable salt, which is an electrolyte in aqueous solution. Examples of salts include, but are not limited to, magnesium sulfate, magnesium sulfate heptahydrate, magnesium chloride, calcium sulfate, and calcium chloride. Magnesium sulfate (heptahydrate) is particularly suitable. While such salts may have been used in previous compositions, their amounts have been less than 1.5 weight %. In the present compositions, the amount is 1.5 to 5 weight %, 2 to 5 weight %, 2 to 4 weight %, or 2, 2.5, 3, 3.5, 4, 4.5, or 5 weight %. In the compositions, the divalent metal salt is dissolved in aqueous solution, rendering the composition visually clear, independent of the degree of dilution. It is desired that the divalent metal salt be dissolved in the composition. When less water is in the composition, it may be that higher amounts of the divalent metal salt may not be able to be used because the salt may crystallize out of the composition.

The divalent salt acts to raise the viscosity of the composition, dependent upon dilution. The divalent metal salts do not pack as closely with the anionic surfactants as do monovalent metal salts, such as sodium. Sodium ions can interact with anionic surfactants to form rod-like micelles that are more closely packed. The closer the packing, the more likely that a gel phase will be encountered upon dilution.

The surfactants and their amounts are selected in combination with the amount of divalent metal salt to create a relatively constant viscosity curve when the compositions are diluted from as high as 50 wt % active surfactant ingredients (hereinafter referred to as AI) to as low as 5 wt % AI. There is no gel phase or a high viscosity peak that is greater than 1,200 mPas occurring upon dilution. In the high AI range, the concentrated formulas are clear and flowable with a viscosity ranging from 100 to 500 mPas. Upon dilution to lower AI range, the dilute formulas exhibit a stable viscosity above 100 mPas. Upon dilution, the concentrated formulas mix readily with water and maintain stable viscosities over a wide rang of active levels up to 6-fold dilution. Upon dilution, a viscosity peak of over 1200 mPas is not observed, which makes the formulas very easy to dilute with water. In certain embodiments, the diluted viscosity is no more than 200 mPas, no more than 150 mPas, or no more than 100 mPas less than the initial viscosity.

Other ingredients that may be included to assist achievement of the desired viscosity profile of the compositions upon dilution are viscosity modifiers, for example a block copolymer of ethylene oxide and propylene oxide, typically Pluronic L44 available from BASF AG, Germany, and hydrotropes, for example sodium xylene sulfonate (SXS), alcohol, such as ethyl alcohol, and glycol, such as propylene glycol. The compositions can be formulated as cleaning liquids such as hand dishwashing detergents, liquid hand soaps, shampoos, and body washes, etc. The compositions also present an eco-friendly option for liquid cleaning detergents. Particularly preferred embodiments are directed to hand dishwashing detergents. The composition can be sold in a smaller pack, since it is in concentrated form. As a result, transportation energy and packaging materials can be reduced. When the concentrated composition is diluted by consumers at home, for example by being diluted with additional water in a reusable container, the consumption of plastic waste can be further reduced.

In this specification, the viscosity of the composition, in concentrated or undiluted form, or in diluted form, is measured using a Brookfield RVT Viscometer using spindle 21 at 20 RPM at 25° C.

As described above, surfactants are used in the composition. These may be anionic, amphoteric or nonionic surfactants. Various examples of such surfactants that may be used in the compositions are described hereinbelow.

Anionic surfactants include, but are not limited to, those surface-active or detergent compounds that contain an organic hydrophobic group containing generally 8 to 26 carbon atoms or generally 10 to 18 carbon atoms in their molecular structure and at least one water-solubilizing group selected from sulfonate, sulfate, and carboxylate so as to form a water-soluble detergent. Usually, the hydrophobic group will comprise a $C_8$-$C_{22}$ alkyl, or acyl group. Such surfactants are employed in the form of water-soluble salts and the salt-forming cation usually is selected from sodium, potassium, ammonium, magnesium and mono-, di- or tri-$C_2$-$C_3$ alkanolammonium, with the sodium, magnesium and ammonium cations again being the usual ones chosen.

The anionic surfactants that are used in the composition are water soluble and include, but are not limited to, the sodium, potassium, ammonium, magnesium and ethanolammonium salts of linear $C_8$-$C_{16}$ alkyl benzene sulfonates (such as dodecyl benzene sulfonate), alkyl ether carboxylates, $C_{10}$-$C_{20}$ paraffin sulfonates, $C_8$-$C_{25}$ alpha olefin sulfonates, $C_8$-$C_{18}$ alkyl sulfates, alkyl ether sulfates (such as $C_{12}$-$C_{15}$ alkyl ethoxysulfate with 1.3 ethoxylate groups per molecule, e.g. sodium laureth sulfate) and mixtures thereof.

The paraffin sulfonates (also known as secondary alkane sulfonates) may be monosulfonates or di-sulfonates and usually are mixtures thereof, obtained by sulfonating paraffins of 10 to 20 carbon atoms. Commonly used paraffin sulfonates are those of C12-18 carbon atoms chains, and more commonly they are of C14-17 chains Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the C14-17 range will be minor and will be minimized, as will be any contents of di- or poly-sulfonates. Examples of paraffin sulfonates include, but are not limited to HOSTAPUR™ SAS30, SAS 60, SAS 93 secondary alkane sulfonates from Clariant, and BIO-TERGE™ surfactants from Stepan, and CAS No. 68037-49-0.

Pareth sulfate surfactants can also be included in the composition. The pareth sulfate surfactant is a salt of an ethoxylated $C_{10}$-$C_{16}$ pareth sulfate surfactant having 1 to 30 moles of ethylene oxide. In some embodiments, the amount of ethylene oxide is 1 to 6 moles, and in other embodiments it is 2 to 3 moles, and in another embodiment it is 2 moles. In one embodiment, the pareth sulfate is a $C_{12}$-$C_{13}$ pareth sulfate with 2 moles of ethylene oxide. An example of a pareth sulfate surfactant is STEOL™ 23-2S/70 from Stepan, or (CAS No. 68585-34-2).

Examples of suitable other sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or $C_{8-15}$ alkyl toluene sulfonates. In one embodiment, the alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Materials that can be used are found in U.S. Pat. No. 3,320,174, especially those in which the alkyls are of 10 to 13 carbon atoms.

Other suitable anionic surfactants are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. In one embodiment, olefin sulfonates contain from 14 to 16 carbon atoms in the R alkyl group and are obtained by sulfonating an alpha-olefin.

Examples of satisfactory anionic sulfate surfactants are the alkyl sulfate salts and the alkyl ether polyethenoxy sulfate salts having the formula $R(OC_2H_4)_n OSO_3M$ wherein n is 1 to 12, or 1 to 5, and R is an alkyl group having about 8 to about 18 carbon atoms, or 12 to 15 and natural cuts, for example, $C_{12-14}$ or $C_{12-46}$ and M is a solubilizing cation selected from sodium, potassium, ammonium, magnesium and mono-, di- and triethanol ammonium ions. The alkyl sulfates may be obtained by sulfating the alcohols obtained by reducing glycerides of coconut oil or tallow or mixtures thereof and neutralizing the resultant product.

The ethoxylated alkyl ether sulfate may be made by sulfating the condensation product of ethylene oxide and $C_{8-18}$ alkanol, and neutralizing the resultant product. The ethoxylated alkyl ether sulfates differ from one another in the number of carbon atoms in the alcohols and in the number of moles of ethylene oxide reacted with one mole of such alcohol. In one embodiment, alkyl ether sulfates contain 12 to 15 carbon atoms in the alcohols and in the alkyl groups thereof, e.g., sodium myristyl (3 EO) sulfate or ammonium laureth (1.3 EO) sulfate.

Ethoxylated $C_{8-18}$ alkylphenyl ether sulfates containing from 2 to 6 moles of ethylene oxide in the molecule are also suitable for use in the compositions. These detergents can be prepared by reacting an alkyl phenol with 2 to 6 moles of ethylene oxide and sulfating and neutralizing the resultant ethoxylated alkylphenol.

Other suitable anionic detergents are the $C_9$-$C_{15}$ alkyl ether polyethenoxyl carboxylates having the structural formula $R(OC_2H_4)_nOX$ COOH wherein n is a number from 4 to 12, preferably 6 to 11 and X is selected from the group consisting of $CH_2$, $C(O)R_1$ and

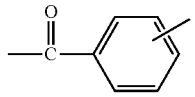

wherein $R_1$ is a $C_1$-$C_3$ alkylene group. Types of these compounds include, but are not limited to, $C_9$-$C_{11}$ alkyl ether polyethenoxy (7-9) $C(O)CH_2CH_2COOH$, $C_{13}$-$C_{15}$ alkyl ether polyethenoxy (7-9)

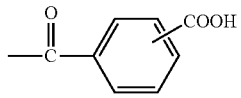

and $C_{10}$-$C_{12}$ alkyl ether polyethenoxy (5-7) $CH_2COOH$. These compounds may be prepared by condensing ethylene oxide with appropriate alkanol and reacting this reaction product with chloracetic acid to make the ether carboxylic acids as shown in U.S. Pat. No. 3,741,911 or with succinic anhydride or phtalic anhydride.

In certain embodiments, the composition can exclude alkali metal alkyl ether sulfate, sodium lauryl ether sulfate, alkali metal alkyl sulfate, or sodium lauryl sulfate anionic surfactants.

The nonionic surfactants may include amine oxides. Such an amine oxide is depicted by the formula:

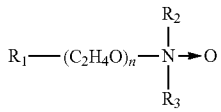

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms; $R_2$ and $R_3$ are each methyl, ethyl, propyl, isopropyl, 2-hydroxyethyl, 2-hydroxypropyl, or 3-hydroxypropyl; and n is from 0 to about 10. In one embodiment, the amine oxides are of the formula:

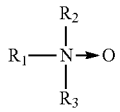

wherein $R_1$ is a $C_{12-18}$ alkyl and $R_2$ and $R_3$ are methyl or ethyl. The above ethylene oxide condensates, amides, and amine oxides are more fully described in U.S. Pat. No. 4,316,824. In another embodiment, the amine oxide is depicted by the formula:

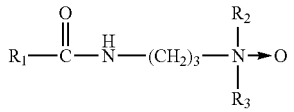

wherein $R_1$ is a saturated or unsaturated alkyl group having about 6 to about 24 carbon atoms, $R_2$ is a methyl group, and $R_3$ is a methyl or ethyl group. The amine oxide may be cocoamidopropyl-dimethylamine oxide. The preferred amine oxide is at least one of, or preferably a mixture of, lauramidopropylamine oxide and myristamidopropylamine oxide.

The water soluble nonionic surfactants utilized are commercially well known and include the primary aliphatic alcohol ethoxylates, secondary aliphatic alcohol ethoxylates, alkylphenol ethoxylates and ethylene-oxide-propylene oxide condensates on primary alkanols, such a PLURAFAC™ surfactants (BASF) and condensates of ethylene oxide with sorbitan fatty acid esters such as the TWEEN™ surfactants (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic surfactant class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

In one embodiment, the nonionic surfactants are the NEODOL™ ethoxylates (Shell Co.), which are higher aliphatic, primary alcohol containing about 9-15 carbon atoms, such as $C_9$-$C_{11}$ alkanol condensed with 2.5 to 10 moles of ethylene oxide (NEODOL™ 91-2.5 OR -5 OR -6 OR -8), $C_{12-13}$ alkanol condensed with 6.5 moles ethylene oxide (NEODOL™ 23-6.5), $C_{12-15}$ alkanol condensed with 12 moles ethylene oxide (NEODOL™ 25-12), $C_{14-15}$ alkanol condensed with 13 moles ethylene oxide (NEODOL™ 45-13), and the like.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$-$C_{15}$ secondary alkanol condensed with either 9 EO (TERGITOL™ 15-S-9) or 12 EO (TERGITOL™ 15-S-12) marketed by Union Carbide.

Other suitable nonionic surfactants include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include, but are not limited to, nonyl phenol condensed with about 9.5 moles of EO per mole of nonyl phenol, dinonyl phenol condensed with about 12 moles of EO per mole of phenol, dinonyl phenol condensed with about 15 moles of EO per mole of phenol and di-isoctylphenol condensed with about 15 moles of EO per mole of phenol. Commercially available nonionic surfactants of this type include IGEPAL™ CO-630 (nonyl phenol ethoxylate) marketed by GAF Corporation.

Also among the satisfactory nonionic surfactants are the water-soluble condensation products of a $C_8$-$C_{20}$ alkanol with a heteric mixture of ethylene oxide and propylene oxide wherein the weight ratio of ethylene oxide to propylene oxide is from 2.5:1 to 4:1, preferably 2.8:1 to 3.3:1, with the total of the ethylene oxide and propylene oxide (including the terminal ethanol or propanol group) being from 60-85%, preferably 70-80%, by weight. Such detergents are commercially available from BASF and a particularly preferred detergent is a $C_{10}$-$C_{16}$ alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-$C_{10}$-$C_{20}$ alkanoic acid esters having a HLB of 8 to 15 also may be employed as the nonionic detergent ingredient in the described composition. These surfactants are well known and are available from Imperial Chemical Industries under the TWEEN™ trade name. Suitable surfactants include, but are not limited to, polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic surfactants are marketed under the trade name PLURONIC™. The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L 62 and L 64.

Alkyl polysaccharide nonionic surfactants can be used in the instant composition. Such alkyl polysaccharide nonionic surfactants have a hydrophobic group containing from about 8 to about 20 carbon atoms, preferably from about 10 to about 16 carbon atoms, or from about 12 to about 14 carbon atoms, and polysaccharide hydrophilic group containing from about 1.5 to about 10, or from about 1.5 to about 4, or from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4-positions rather than at the 1-position, (thus giving e.g. a glucosyl or galactosyl as opposed to a glucoside or galactoside). However, attachment through the 1-position, i.e., glucosides, galactoside, fructosides, etc is preferred. In one embodiment, the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. In one embodiment, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides include, but are not limited to, decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides can be used. Suitable mixtures include coconut alkyl, di-, tri-, tetra-, and pentaglucosides and tallow alkyl tetra-, penta-, and hexaglucosides.

In one embodiment, the alkyl polysaccharides are alkyl polyglucosides having the formula $$R_2O(C_nH_{2n}O)_r(Z)_x$$

wherein Z is derived from glucose, R is a hydrophobic group selected from alkyl, alkylphenyl, hydroxyalkylphenyl, and mixtures thereof in which said alkyl groups contain from about 10 to about 18, preferably from about 12 to about 14 carbon atoms; n is 2 or 3, r is from 0 to 10; and x is from 1.5 to 8, or from 1.5 to 4, or from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucosde content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is generally less than about 2%, or less than about 0.5% by weight of the total of the alkyl polysaccharide. For some uses it is desirable to have the alkyl monosaccharide content less than about 10%.

"Alkyl polysaccharide surfactant" is intended to represent both the glucose and galactose derived surfactants and the alkyl polysaccharide surfactants. Throughout this specification, "alkyl polyglucoside" is used to include alkyl polyglycosides because the stereochemistry of the saccharide moiety is changed during the preparation reaction.

In one embodiment, APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=122 (65%); n=14 (21-28%); n=16 (4-8%) and n=18 (0.5%) and x (degree of polymerization)= 1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5-10 RPM of 3,000 to 7,000 cps.

The amphoteric can be any amphoteric surfactant and in particular may be a zwitterionic surfactant. In one embodiment, the zwitterionic surfactant is a water soluble betaine having the general formula

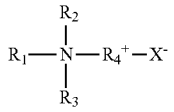

wherein $X^-$ is selected from $COO^-$ and $SO_3^-$ and $R_1$ is an alkyl group having 10 to about 20 carbon atoms, or 12 to 16 carbon atoms, or the amido radical:

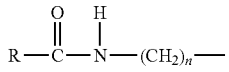

wherein R is an alkyl group having about 9 to 19 carbon atoms and n is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include, but are not limited to, decyl dimethyl betaine or 2-(N-decyl-N,N-dimethyl-ammonia) acetate, coco dimethyl betaine or 2-(N-coco N,N-dimethylammonia) acetate, myristyl dimethyl betaine, palmityl dimethyl betaine, lauryl dimethyl betaine, cetyl dimethyl betaine, stearyl dimethyl betaine, etc. The amidobetaines similarly include, but are not limited to, cocoamidoethylbetaine, cocoamidopropyl betaine, lauramidipropyl betaine and the like. The amidosulfobetaines include, but are not limited to, cocoamidoethylsulfobetaine, cocoamidopropyl sulfobetaine and the like. In one embodiment, the betaine is coco ($C_8$-$C_{18}$) amidopropyl dimethyl betaine. Three examples of betaine surfactants that can be used are EMPIGEN™ BS/CA from Albright and Wilson, REWOTERIC™ AMB 13 and Goldschmidt Betaine L7.

The composition may also contain solvents to modify the cleaning, stability and rheological properties of the composition.

Solvents can include any water soluble solvents, which preferably act as hydrotropes. Water soluble solvents include, but are not limited to, $C_{2-4}$ mono, dihydroxy, or polyhydroxy alkanols and/or an ether or diether, such as ethanol, isopropanol, diethylene glycol monobutyl ether, dipropylene glycol methyl ether, diproyleneglycol monobutyl ether, propylene glycol n-butyl ether, propylene glycol, and hexylene glycol, and alkali metal cumene, alkali metal toluene, or alkali metal xylene sulfonates such as sodium cumene sulfonate and sodium xylene sulfonate (SXS). In some embodiment, the solvents include ethanol and diethylene glycol monobutyl ether, both of which are miscible with water. Urea can be optionally used at a concentration of 0.1% to 7 weight %. Solvents such as ethanol (typically used at 5 to 12 wt %), SXS (typically used at 0.25 to 1 wt %) and propylene glycol (typically used at 0.5 to 5 wt %) act to lower the viscosity of the composition, dependent upon dilution.

Further viscosity modifiers may also be included, such as a polymer, for example a block copolymer of propylene oxide and ethylene oxide, e.g. the block copolymer sold under the trade mark Pluronic L44 by BASF AG, Germany.

Additional optional ingredients may be included to provide added effect or to make the product more attractive. Such ingredients include, but are not limited to, perfumes, fragrances, abrasive agents, disinfectants, radical scavengers, bleaches, acids, chelating agents, antibacterial agents/preservatives, optical brighteners, or combinations thereof.

In some embodiments, preservatives can be used in the composition at a concentration of 0 wt. % to 3 wt. %, more preferably 0.01 wt. % to 2.5 wt. %. Examples of preservatives include, but are not limited to, benzalkonium chloride; benzethonium chloride, 5-bromo-5-nitro-1,3dioxane; 2-bromo-2-nitropropane-1,3-diol; alkyl trimethyl ammonium bromide; N-(hydroxymethyl)-N-(1,3-dihydroxy methyl-2,5-dioxo-4-imidaxolidinyl-N'-(hydroxy methyl)urea; 1-3-dimethyol-5,5-dimethyl hydantoin; formaldehyde; iodopropynl butyl carbamate, butyl paraben; ethyl paraben; methyl paraben; propyl paraben, mixture of methyl isothiazolinone/methyl-chloroisothiazoline in a 1:3 wt. ratio; mixture of phenoxythanol/butyl paraben/methyl paraben/propylparaben; 2-phenoxyethanol; tris-hydroxyethyl-hexahydrotriazine; methylisothiazolinone; 5-chloro-2-methyl-4-isothiazolin-3-one; 1,2-dibromo-2,4-dicyanobutane; 1-(3-chloroalkyl)-3,5,7-triaza-azoniaadam-antane chloride; and sodium benzoate.

Water is included in the aqueous composition. The amount of water is variable depending on the amounts of other materials added to the composition.

The compositions can be made by simple mixing methods from readily available components which, on storage, do not adversely affect the entire composition. Mixing can be done by any mixer that forms the composition. Examples of mixers include, but are not limited to, static mixers and in-line mixers. Solubilizing agents such as a $C_1$-$C_3$ alkyl substituted benzene sulfonate such as sodium cumene or sodium xylene sulfonate (SXS) and mixtures thereof can be used at a concentration of 0.5 wt. % to 10 wt. % to assist in solubilizing the surfactants.

EXAMPLES

The following examples illustrate a composition of the invention. Unless otherwise specified, all percentages are by weight. The exemplified composition is illustrative only and does no limit the scope of the invention. Unless otherwise specified, the proportions in the examples and elsewhere in the specification are by active weight. The active weight of a material is the weight of the material itself excluding water or other materials that may be present in the supplied form of the material.

Examples 1 to 4

In accordance with Examples 1 to 4, the compositions shown in Table 1 are examples of formulas in accordance with the invention that exhibit generate acceptable viscosity, i.e. greater than 100 mPas, both when formulated and when diluted at up to 3-fold and even up to 6-fold dilution. The dilution value is calculated so that, for example, 2-fold dilution means that the initial volume of the undiluted composition is mixed with an equal quantity of water so that the total volume is twice the initial volume of the undiluted composition, and therefore the initial volume is one half of the final diluted composition.

In Table 1, and subsequent tables, the following components are identified:

MgLAS—an anionic surfactant, in particular magnesium linear alkyl benzene sulfonate, in particular dodecyl benzene sulfonate LMDO (AO)—a nonionic surfactant, in particular an amine oxide, in particular a mixture of lauramidopropylamine oxide and myristamidopropylamine oxide $NH_4$AEOS—an anionic surfactant, in particular a fatty acid ethoxylate sulfate, in particular ammonium C12-C15 alkyl ethoxysulfate with 1.3 ethoxylate groups per molecule, most particularly ammonium laureth sulfate CAPB—an amphoteric surfactant, in particular cocoamidopropyl betaine LAPB—an amphoteric surfactant, in particular lauramidopropyl betaine Pluronic L44—a block copolymer of propylene oxide and ethylene oxide, available in commerce from BASF AG, Germany It may be seen that the compositions of Examples 1 to 4 incorporated a mixture of anionic surfactants, magnesium linear alkyl benzene sulfonate and fatty acid ethoxylate sulfate, and either the nonionic surfactant, in particular the amine oxide, or the amphoteric surfactant, in particular cocoamidopropyl betaine, in the respective amounts indicated. The viscosity modifying salt was magnesium sulfate in the respective amounts indicated. No other viscosity modifier was used. The total surfactant active components, based on the weight of the composition, ranged from 33.5 to 39 weight %.

Table 2 shows the viscosity, in mPas measured as indicated above, of the compositions of each of Examples 1 to 4, both initially when undiluted and after various degrees of dilution with water, as indicated.

It may be seen that for each Example the initial viscosity is greater than 200 MPas at 25° C. and the viscosity does not exceed 700 mPas at 25° C. during dilution up to 6 times of the original composition volume with water.

This shows a flat viscosity profile for each of the compositions of Examples 1 to 4, over a wide range of surfactant activity levels in the differently diluted compositions.

A dilutable dishwashing liquid in accordance with any of Examples 1 to 4 could be supplied to the consumer in concentrated form, and the composition would have a consumer-acceptable viscosity. The consumer could readily dilute the composition to a desired dilution value within a specified range, for example to a value or within a range indicated on instructions associated with the package of the dishwashing liquid. The diluted composition would then be ready to use by the consumer, in homogeneous form, and would have acceptable viscosity not only after dilution but also during the dilution process, making it easier to effect the dilution by simple mixing of the water and composition and simple inverting or gentle shaking.

TABLE 1

| Composition | Example 1 | Example 2 | Example 3 | Example 4 |
|---|---|---|---|---|
| MgLAS | 12 | 12 | 12 | 6.5 |
| LMDO | 10 | 10 | 10 | — |
| $NH_4AEOS$ | 17 | 17 | 17 | 17 |
| CAPB | — | — | — | 10 |
| $MgSO_4 \cdot 7H_2O$ | 3.5 | 4.0 | 3.0 | 3.5 |
| Water | to 100 | to 100 | to 100 | to 100 |
| Total surfactant active ingredients (AI) | 39 | 39 | 39 | 33.5 |

TABLE 2

| Viscosity values, mPas at 25° C. | | | | |
|---|---|---|---|---|
| Dilution Factor | Example 1 | Example 2 | Example 3 | Example 4 |
| Initial (100%) | 348 | 358 | 345 | 243 |
| 75% | 433 | 463 | 500 | 378 |
| 2X (50%) | 483 | 605 | 698 | 418 |
| 3X | 343 | Not measured | Not measured | Not measured |
| 4X | 258 | 323 | 568 | 298 |
| 5X | 243 | 308 | 598 | 285 |
| 6X | 220 | 298 | 713 | Not measured |

Examples 5 to 11

In accordance with Examples 5 to 11, the compositions shown in Table 3 are examples of further formulas, suitable for a dilutable dishwashing composition, in accordance with the invention that exhibit generate acceptable viscosity, i.e. greater than 100 mPas, both when formulated and when diluted at up to 3-fold and even up to 6-fold dilution. These compositions exhibit total surfactant active ingredients (AI) at 35.1% based on the weight of the composition. Pluronic L44 is added as a viscosity modifier for these compositions.

These compositions do not include a linear alkyl benzene sulfonate. Only a single anionic surfactant and a single amphoteric surfactant are present as surfactant actives.

Like Table 2, Table 4 shows the viscosity profile initially and upon dilution with water. It may be seen from Table 4 that for each Example the initial viscosity is greater than 150 MPas at 25° C. and the viscosity does not exceed 750 mPas at 25° C. during dilution up to 5 times of the original composition volume with water.

This again shows a flat viscosity profile for each of the compositions of Examples 5 to 11 over a wide range of surfactant activity levels in the differently diluted compositions.

TABLE 3

| Composition | Example 5 | Example 6 | Example 7 | Example 8 | Example 9 | Example 10 | Example 11 |
|---|---|---|---|---|---|---|---|
| Weight ratio of AEOS/CAPB | 1.7 | 2.0 | 2.2 | 2.2 | 2.2 | 2.5 | 2.5 |
| $NH_4AEOS$ | 22.10 | 23.40 | 24.13 | 24.13 | 24.13 | 25.07 | 25.07 |
| CAPB | 13.00 | 11.70 | 10.97 | 10.97 | 10.97 | 10.03 | 10.03 |
| Pluronic L44 | 0.5 | 0.4 | 0.5 | 0.4 | 0.3 | 0.4 | 0.5 |
| $MgSO_4 \cdot 7H_2O$ | 2 | 2 | 3.5 | 2 | 2 | 3.5 | 3.5 |
| Water | to 100 | to 100 | to 100 | to 100 | to 100 | to 100 | to 100 |
| Total AI | 35.1 | 35.1 | 35.1 | 35.1 | 35.1 | 35.1 | 35.1 |

TABLE 4

| Viscosity values, mPas at 25° C. | | | | | | | |
|---|---|---|---|---|---|---|---|
| Dilution Factor | Example 5 | Example 6 | Example 7 | Example 8 | Example 9 | Example 10 | Example 11 |
| Initial (100%) | 218 | 250 | 168 | 228 | 208 | 158 | 165 |
| 75% | 393 | 398 | 290 | 330 | 320 | 203 | 250 |
| 2X (50%) | 680 | 688 | 525 | 493 | 638 | 397 | 460 |
| 3X | 650 | 708 | 628 | 478 | 738 | 555 | 440 |
| 4X | 325 | 335 | 475 | 230 | 313 | 400 | 278 |
| 5X | 90 | 138 | 240 | 38 | 108 | 240 | 73 |

Examples 12 to 17

In accordance with Examples 12 to 17, the compositions shown in Table 5 are examples of further formulas, suitable for a dilutable dishwashing composition, in accordance with the invention that exhibit generate acceptable viscosity, i.e. greater than 100 mPas, both when formulated and when diluted at up to 3-fold and even up to 6-fold dilution. These compositions exhibit total surfactant active ingredients (AI) at 40 to 45% based on the weight of the composition, higher than for Examples 5 to 11.

Again, Pluronic L44 is added as a viscosity modifier for these compositions and the compositions do not include a linear alkyl benzene sulfonate. Only a single anionic surfactant and a single amphoteric surfactant are present as surfactant actives.

Like Table 4, Table 6 shows the viscosity profile initially and upon dilution with water. It may be seen from Table 4 that for each Example the initial viscosity is greater than 140 MPas at 25° C. and the viscosity does not exceed 885 mPas at 25° C. during dilution up to 5 times of the original composition volume with water.

This again shows a flat viscosity profile for each of the compositions of Examples 12 to 17 over a wide range of surfactant activity levels in the differently diluted compositions.

TABLE 5

| Composition | Example 12 | Example 13 | Example 14 | Example 15 | Example 16 | Example 17 |
|---|---|---|---|---|---|---|
| Weight ratio of AEOS/LAPB | 2.7 | 3.0 | 3.2 | 3.5 | 4.0 | 4.0 |
| $NH_4$AEOS | 29.19 | 30 | 30.48 | 31.11 | 33.6 | 36 |
| LAPB | 10.81 | — | 9.52 | 8.89 | 8.4 | 9 |
| CAPB | — | 10 | — | — | — | — |
| Pluronic L44 | 0.3 | 1 | 0.8 | 0.4 | 0.5 | 1 |
| $MgSO_4 \cdot 7H_2O$ | 2 | 2 | 3 | 2 | 2 | 2 |
| Total AI | 40 | 40 | 40 | 40 | 42 | 45 |

TABLE 6

| Viscosity values, mPas at 25° C. | | | | | | |
|---|---|---|---|---|---|---|
| Dilution Factor | Example 12 | Example 13 | Example 14 | Example 15 | Example 16 | Example 17 |
| Initial (100%) | 258 | 313 | 140 | 160 | 175 | 198 |
| 75% | 365 | 668 | 225 | 355 | 453 | 458 |
| 2X (50%) | 478 | 675 | 250 | 525 | 770 | 885 |
| 3X | 193 | 515 | 213 | 363 | 413 | 468 |
| 4X | 140 | 343 | 123 | 125 | 108 | 120 |
| 5X | 145 | 270 | 118 | 130 | 108 | 110 |

Example 18 and Comparative Examples 1 to 3

In accordance with Example 18 and Comparative Examples 1 to 3, the compositions shown in Table 7 are examples of further formulas, expressed as active ingredients (AI), suitable for a dilutable dishwashing composition, which exhibit varying viscosity dependent upon the selection of the specific electrolyte salt. In Example 18, the salt was magnesium sulfate at 3.5 wt %. In Comparative Examples 1 to 3 either no salt was provided in Comparative Example 1 and the composition contained an additional 3.5 wt %. water, or the salt was similarly provided at 3.5 wt % and was sodium chloride as in Comparative Example 2 or sodium sulfate as in Comparative Example 3. The base formulation included 13 wt % active anionic surfactant in magnesium linear alkyl benzene sulfonate, 17 wt % active anionic surfactant in ammonium laureth sulfate and 10 wt % active nonionic surfactant in lauryl myristal amine oxide. Ethyl alcohol and SXS were also present as hydrotropes. Perfume was present. The balance was water. The pH of the base composition was 7.35.

Table 8 shows the viscosity profile initially and upon dilution with water. For measuring a thick gel-like consistency in Comparative Example 3, the viscosity was measured at a lower rotation speed than the 20 rpm used for the Examples.

It may be seen that the use of magnesium sulfate as the divalent metal salt in the dilutable dishwashing composition provided a significantly flatter viscosity profile on aqueous dilution of the initial concentrate. Using magnesium sulfate the viscosity was consistently between 200 and 500 mPas. For both sodium chloride as in Comparative Example 2 and sodium sulfate as in Comparative Example 3, the viscosity in the same dilution range exceeded 2000 mPas. When no electrolyte salt was present the viscosity in the same dilution range reached 2000 mPas.

TABLE 7

| Composition | Example 18 | Comparative Example 1 | Comparative Example 2 | Comparative Example 3 |
|---|---|---|---|---|
| MgLAS | 13 | 13 | 13 | 13 |
| $NH_4$AEOS | 17 | 17 | 17 | 17 |
| Lauryl myristal amine oxide | 10 | 10 | 10 | 10 |
| Ethyl (SD No. 3) alcohol | 2 | 2 | 2 | 2 |
| 40 wt % SXS solution | 2 | 2 | 2 | 2 |
| Perfume | 1 | 1 | 1 | 1 |
| $MgSO_4$ | 3.5 | — | — | — |
| NaCl | — | — | 3.5 | — |
| $Na_2SO_4$ | — | — | — | 3.5 |
| Water | to 100 | to 100 | to 100 | to 100 |
| Total surfactant AI | 40 | 40 | 40 | 40 |

TABLE 8

| Viscosity values, mPas at 25° C. | | | | |
|---|---|---|---|---|
| Dilution Factor | Example 18 | Comparative Example 1 | Comparative Example 2 | Comparative Example 3 |
| Initial (100%) | 375 | 705 | 142.5 | 310 |
| 75% | 440 | 845 | 250 | 510 |
| 50% | 510 | 2000 | 412.5 | 1240 |
| 25% | 282.5 | 1517 | 1612 | 3505 (at 10 rpm) |
| 20% | 252.5 | 217.5 | 2380 | 2298 |

Example 19 and Comparative Examples 4 to 6

In accordance with Example 19 and Comparative Examples 4 and 5, the compositions shown in Table 9 are examples of further formulas, expressed as active ingredients (AI), suitable for a dilutable dishwashing composition, which exhibit varying viscosity dependent upon the selection of the specific divalent metal salt. In Example 19 the salt was magnesium sulfate at 3.5 wt %. In Comparative Example 4 the salt was sodium chloride and in Comparative Example 5 the salt was sodium sulfate. The base formulation included 6.5 wt % active anionic surfactant in magnesium linear alkyl benzene sulfonate, 17 wt % active anionic surfactant in ammonium laureth sulfate and 10 wt % active amphoteric surfactant in cocoamidopropyl betaine. Ethyl alcohol and SXS were also present as hydrotropes. Perfume was present. The balance was water. The pH of each composition was within the range 6.5 to 7.0.

In Comparative Example 6 the anionic surfactant active concentration was varied. The salt was magnesium sulfate at 3.5 wt % but the base formulation was modified to have as the anionic surfactant only 17 wt % (i.e. below 20 wt5) active anionic surfactant in ammonium laureth sulfate. The 6.5 wt % active anionic surfactant in magnesium linear alkyl benzene sulfonate of the base formulation was replaced with water.

Table 10 shows the viscosity profile initially and upon dilution with water. For measuring a thick gel-like consistency in the Comparative Examples, the viscosity was measured at a lower rotation speed than the 20 rpm used for the Examples.

It may be seen that the use of magnesium sulfate as the divalent metal salt in the dilutable dishwashing composition provided a significantly flatter viscosity profile on aqueous dilution of the initial concentrate, provided that the anionic active component was present at above 20 weight %. Using magnesium sulfate in combination with the anionic active component present at above 20 weight %, the viscosity was consistently between 200 and 500 mPas. For both sodium chloride as in Comparative Example 1 and sodium sulfate as in Comparative Example 2 the viscosity in the same dilution range exceeded 8000 mPas. When insufficient anionic active was present as in Comparative Example 3 the viscosity in the same dilution range exceeded 8000 mPas.

TABLE 9

| Composition | Example 19 | Comparative Example 4 | Comparative Example 5 | Comparative Example 6 |
|---|---|---|---|---|
| MgLAS | 6.5 | 6.5 | 6.5 | — |
| $NH_4AEOS$ | 17 | 17 | 17 | 17 |
| CAPB | 10 | 10 | 10 | 10 |
| Ethyl (SD No. 3) alcohol | 2 | 2 | 2 | 2 |

TABLE 9-continued

| Composition | Example 19 | Comparative Example 4 | Comparative Example 5 | Comparative Example 6 |
|---|---|---|---|---|
| 40 wt % SXS solution | 2 | 2 | 2 | 2 |
| Perfume | 1 | 1 | 1 | 1 |
| $MgSO_4$ | 3.5 | — | — | 3.5 |
| NaCl | — | 3.5 | — | — |
| $Na_2SO_4$ | — | — | 3.5 | — |
| Water | to 100 | to 100 | to 100 | to 100 |
| Total surfactant AI | 33.5 | 33.5 | 33.5 | 27 |
| Anionic surfactant AI | 23.5 | 23.5 | 23.5 | 17 |

TABLE 10

| Viscosity values, mPas at 25° C. | | | | |
|---|---|---|---|---|
| Dilution Factor | Example 19 | Comparative Example 4 | Comparative Example 5 | Comparative Example 6 |
| Initial (100%) | 242.5 | 135 | 175 | 575 |
| 75% | 377.5 | 240 | 412.5 | 1690 |
| 50% | 417.5 | 495 | 1745 | 8950 (at 5 rpm) |
| 25% | 297.5 | 8230 (at 5 rpm) | 9440 (at 5 rpm) | Thick gel - not measured |
| 20% | 285 | 8080 (at 5 rpm) | 2005 | Thick gel - not measured |

What is claimed is:

1. An aqueous, dilutable, liquid cleaning composition comprising a. a plurality of surfactants, the surfactants including surfactant active components comprising from greater than 30% to up to 55% by weight, based on the weight of the composition, wherein the plurality of surfactants includes i. at least one anionic surfactant, the total anionic surfactant active component comprising from greater than 20% to up to 40% by weight, based on the weight of the composition; and ii. at least one additional surfactant selected from at least one amphoteric surfactant and at least one nonionic surfactant, wherein when at least one amphoteric surfactant is present, the total amphoteric active component comprises from greater than 5% to up to 15% by weight, based on the weight of the composition; and when at least one nonionic surfactant is present, the total nonionic active component comprises from greater than 5% to up to 15% by weight, based on the weight of the composition;

b. at least one divalent metal salt in an amount of 1.5% to 5% by weight, based on the weight of the composition; and c. a block copolymer of propylene oxide and ethylene oxide;

wherein the composition has a viscosity of 100 to 500 mPas as measured at 25° C., and the composition is dilutable with water to form a non-gelling, diluted composition having up to six times the volume of the undiluted composition and a viscosity within the range of 100 to 1600 mPas as measured at 25° C. at any dilution up to the six times dilution.

2. The composition of claim 1, wherein the surfactant active components comprise from greater than 30% to up to 45% by weight, based on the weight of the composition, and the total anionic surfactant active component comprises from greater than 20% to up to 35% by weight, based on the weight of the composition.

3. The composition of claim 1, wherein the at least one divalent metal salt comprises magnesium sulfate or magnesium sulfate heptahyrate.

4. The composition of claim 1, wherein the at least one divalent metal salt is present in an amount of 2 to 4% by weight, based on the weight of the composition.

5. The composition of claim 1, wherein the at least one anionic surfactant is selected from the group consisting of an alkyl sulfonate and an alkyl ethoxy sulfate.

6. The composition of claim 5, wherein the alkyl sulfonate is a linear alkyl benzene sulfonate.

7. The composition of claim 6, wherein the linear alkyl benzene sulfonate is dodecyl benzene sulfonate.

8. The composition of claim 5, wherein the alkyl ethoxy sulfate is a fatty acid ethoxylate sulfate.

9. The composition of claim 8, wherein the fatty acid ethoxylate sulfate is ammonium laureth sulfate.

10. The composition of claim 5, wherein the at least one anionic surfactant comprises from 10 to 15% by weight linear alkyl benzene sulfonate, and from 15 to 25% by weight fatty acid ethoxylate sulfate, each weight being of the anionic surfactant active component based on the weight of the composition.

11. The composition of claim 5, wherein the at least one anionic surfactant consists of a fatty acid ethoxylate sulfate.

12. The composition of claim 11, wherein the at least one anionic surfactant consists of 20 to 34% by weight fatty acid ethoxylate sulfate as anionic active component, the weight being based on the weight of the composition.

13. The composition of claim 1, wherein the at least one amphoteric surfactant comprises at least one of cocoamidopropyl betaine and laurylamidopropyl betaine.

14. The composition of claim 1, wherein the at least one amphoteric active component is present in an amount of 10 to 13% by weight, based on the weight of the composition.

15. The composition of claim 1, wherein the at least one nonionic surfactant comprises an amine oxide.

16. The composition of claim 15, wherein the amine oxide is at least one of lauramidopropylamine oxide and myristamidopropylamine oxide.

17. The composition of claim 1, wherein the at least one nonionic active component is present in an amount of 8 to 12% by weight, based on the weight of the composition.

18. The composition of claim 1, wherein the surfactant components consist of 25 to 35% by weight anionic active component comprising a mixture of fatty acid ethoxylate sulfate and linear alkyl benzene sulfonate, and 8 to 12% by weight nonionic active component comprising an amine oxide, each weight based on the weight of the composition.

19. The composition of claim 1, wherein the surfactant components consist of at least one anionic surfactant and at least one amphoteric surfactant, wherein the weight ratio at total anionic active component to total amphoteric active component is from 1.7:1 to 4:1.

20. The composition of claim 1, wherein the surfactant components consist of greater than 20 to 27% by weight anionic active component comprising a fatty acid ethoxylate sulfate, and 8 to 14% by weight amphoteric active component comprising at least one of cocoamidopropyl betaine and laurylamidopropyl betaine, each weight based on the weight of the composition.

21. The composition of claim 20, wherein the weight ratio at total anionic active component to total amphoteric active component is from 1.7:1 to 2.5:1.

22. The composition of claim 1, wherein the surfactant components consist of 28 to 34% by weight anionic active component comprising a fatty acid ethoxylate sulfate, and 8 to 12% by weight amphoteric active component comprising at least one of cocoamidopropyl betaine and laurylamidopropyl betaine, each based on the weight of the composition.

23. The composition of claim 22, wherein the weight ratio of total anionic active component to total amphoteric active component is from 2.7:1 to 4:1.

24. The composition of claim 1, wherein the block copolymer of propylene oxide and ethylene oxide is present in an amount of 0.1 to 1% by weight based on the weight of the composition.

25. The composition of claim 1, wherein the composition has a viscosity of 125 to 275 mPas as measured at 25° C.; and the composition is dilutable with water to form a non-gelling diluted composition having up to six times the volume of the undiluted composition and a viscosity of within the range of 120 to 900 mPas as measured at 25° C. at any dilution up to the six times dilution.

26. The composition of claim 1, wherein the diluted viscosity is no more than 200mPas less than the initial viscosity.

27. The composition of claim 1, wherein there is no more than 5 weight % by weight of the composition of a monovalent metal counterion anionic surfactant.

28. The composition of claim 1, which is a dishwashing liquid.

29. A method of preparing a diluted aqueous liquid cleaning composition, the method comprising the step of diluting, with water, a concentrated aqueous liquid cleaning composition according to claim 1 to form a diluted composition which is non-gelling composition having up to six times the volume of the concentrated composition and a viscosity within the range of 100 to 1600 mPas as measured at 25° C. at any dilution up to the six times dilution.

30. An aqueous, dilutable, liquid cleaning composition comprising a. a plurality of surfactants consisting of i. an anionic surfactant active component consisting of from greater than 20% to up to 27% by weight of a fatty acid ethoxylate sulfate, based on the weight of the composition; and ii. 8 to 14% by weight amphoteric active component selected from the group consisting of cocoamidopropyl betaine, laurylamidopropyl betaine, and combinations thereof, each based on the weight of the composition; and b. at least on divalent metal salt in an amount of 1.5% to 5% by weight, based on the weight of the composition;

wherein the composition has a viscosity of 100 to 500 mPas as measured at 25° C., and the composition is dilutable with water to form a non-gelling, diluted composition having up to six times the volume of the undiluted composition and a viscosity within the range of 100 to 1600 mPas as measured at 25° C. at any dilution up to the six times dilution.

31. The composition of claim 30, wherein the weight ratio at total anionic active component to total amphoteric active component is from 1.7:1 to 2.5:1.

32. An aqueous, dilutable, liquid cleaning composition comprising a. a plurality of surfactants consisting of i. an anionic surfactant active component consisting of 28 to 34% by weight of a fatty acid ethoxylate sulfate, based on the weight of the composition; and ii. 8 to 12% by weight amphoteric active component selected from the group consisting of cocoamidopropyl betaine, laurylamidopropyl betaine, and combinations thereof, each based on the weight of the composition; and b. at least one divalent metal salt in an amount of 1.5% to 5% by weight, based on the weight of the composition;

wherein the composition has a viscosity of 100 to 500 mPas as measured at 25° C., and the composition is dilutable with water to form a non-gelling, diluted composition having up to six times the volume of the undiluted composition and a viscosity within the range of 100 to 1600 mPas as measured at 25° C. at any dilution up to the six times dilution.

33. The composition of claim 32, wherein the weight ratio at total anionic active component to total amphoteric active component is from 2.7:1 to 4:1.

* * * * *